United States Patent [19]

Yu

[11] Patent Number: 4,625,967

[45] Date of Patent: Dec. 2, 1986

[54] MOVABLE SURFACE GLOBAL PUZZLE

[76] Inventor: Chin-Lai Yu, 69-51 44th Ave., Woodside, N.Y. 11377

[21] Appl. No.: 740,993

[22] Filed: Jun. 4, 1985

[51] Int. Cl.[4] ..... A63F 9/08

[52] U.S. Cl. ..... 273/153 S; 384/446; 384/2

[58] Field of Search ..... 273/153 S; 403/76, 77, 403/90, 122, 125; 384/446; 308/2 R, 4 R, 6 R

[56] References Cited

U.S. PATENT DOCUMENTS

| | | | |
|---|---|---|---|
| 1,274,294 | 7/1918 | Lobl | 273/153 S |
| 1,555,980 | 10/1925 | Johnson | 273/153 S |
| 3,011,842 | 12/1961 | Norris | 384/446 |
| 3,081,089 | 3/1963 | Gustafson | 273/153 S X |
| 3,608,906 | 9/1971 | Odier | 273/157 R |
| 4,377,286 | 3/1983 | Constantinescu | 273/153 S |
| 4,415,158 | 11/1983 | Engel | 273/153 S |
| 4,441,715 | 4/1984 | Titus | 273/153 S |
| 4,478,418 | 10/1984 | Sherman et al. | 273/153 S |

FOREIGN PATENT DOCUMENTS

| | | | |
|---|---|---|---|
| 387221 | 2/1933 | United Kingdom | 273/153 S |

*Primary Examiner*—Anton O. Oechsle

*Attorney, Agent, or Firm*—Natter & Natter

[57] ABSTRACT

A movable surface global puzzle includes a magnetic core and a concentric shell spaced from and surrounding the core, the shell is divided into component sections as defined by planes passing through a center of the core, and is magnetically held to the core. A plurality of ball bearings interposed between the shell and the core provide for slidable movement of the shell sections about the core and relative to each other. A world map, geometric design or similar pattern is depicted on the surface of and extending over several sections. The object of the puzzle is to rearrange a random distribution of the shell sections by a series of shiftable movements so as to recreate the composite or mosaic pattern. In an alternate arrangement a handle is provided for removal of one or more shell sections from the core to provide an alternate method of play and to facilitate solving the puzzle.

16 Claims, 6 Drawing Figures

FIG. 5
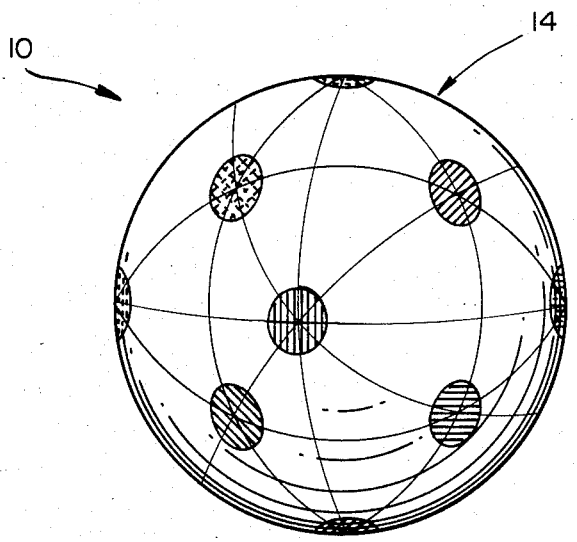
FIG. 4
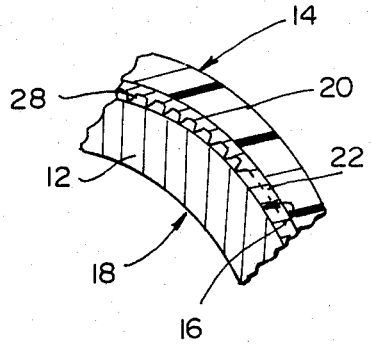
FIG. 6
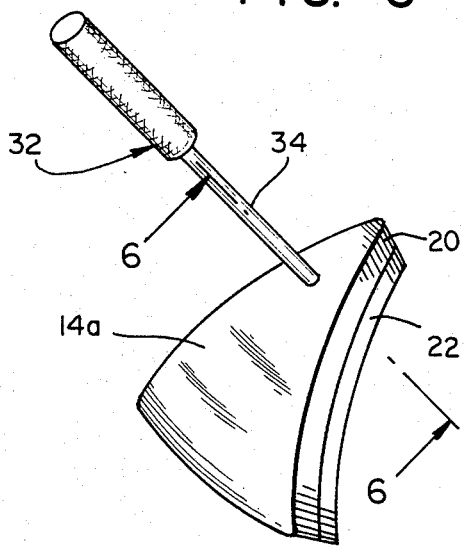
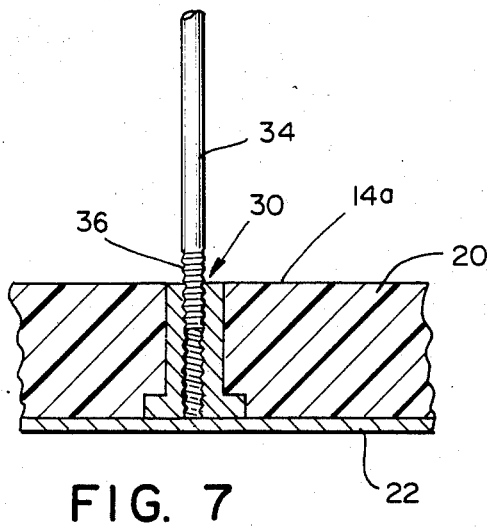
FIG. 7

MOVABLE SURFACE GLOBAL PUZZLE

TECHNICAL FIELD

This invention relates generally to amusement devices and especially to an educational puzzle requiring cognitive skills.

In particular, the spherical puzzle game of this invention concerns the spacial arrangement of movable puzzle sections magnetically attracted to three-dimensional surface.

BACKGROUND ART

The globe puzzles previously disclosed were generally directed to jigsaw puzzles having interlocking puzzle pieces. The puzzle pieces further included mechanical fasteners for removably securing the pieces to the globe surface. Frequently, a guide fixed to the puzzle piece was adapted for securement within a slot on the globe surface or a peg projecting from a puzzle piece was intended for accommodation within a socket formed in the globe surface. Some of those globe puzzles are typically shown in U.S. Pat. Nos. 2,957,251 and 2,987,318.

An inherent defect of those spherical puzzles was that they were designed solely to accommodate interfitting jigsaw puzzle pieces for forming a mosaic pattern. Consequently, with repeated usage the challenge of correctly assembling the puzzle was diminished. Another shortcoming of those global puzzles was that each puzzle piece required a fastener component which added to the expense of manufacture.

Other spherical puzzles utilized permanent magnets in place of fastener devices to hold the puzzle pieces, such as shown in U.S. Pat. Nos. 3,618,955 and 3,865,382. Those devices employed permanent magnets attached to the puzzle piece or otherwise permanently magnetized the puzzle piece for attraction to a spherical base. A disadvantage of that arrangement was that the relatively small puzzle pieces would frequently lose their magnetism after a period of usage. Furthermore, the method of play of those puzzles was directed to a single solution requiring an assembly of interfitting puzzle pieces and did not provide a game of skill using shiftably movable components.

Although the concept of a three dimensional puzzle having shiftable components was, for example, shown in U.S. Pat. No. 4,437,667, that device was dependent upon an internal structural mechanism for providing pivotal movement about three axes and was not directed to slidable surface movement as in the present invention.

DISCLOSURE OF THE INVENTION

Briefly, the nature of this invention encompasses a global puzzle having a magnetized central core and a concentric surface layer or shell of magnetically attractive material. The shell is spaced from the central core and is supported upon steel ball bearings or alternate spur members surrounding the central core. The shell is designed for slidable displacement on the ball bearings and is formed of individual puzzle sections. Selected images such as a world map, geometric designs or other patterns are placed on a surface of the puzzle sections to provide a recognizable pattern or mosaic. Preferably, the images extend between two or more puzzle sections.

The purpose of the movable surface global puzzle of this invention is to rearrange a random distribution of the individual puzzle sections so as to recreate the original pattern. All movement of the puzzle sections is achieved by shifting the sections through a slidable displacement on the central core. In an alternate arrangement one or more of the individual puzzle sections can be physically removed from the central core to facilitate the rearrangement.

It should thus be apparent that the global puzzle of this invention provides a challenge to intellectual and logical skills.

Furthermore, by presenting a world map on the puzzle sections, the global puzzle provides a device for acquiring geographical knowledge and can provoke an interest in travel. An additional application for the global puzzle is that the use of different colors in the formation of geometric patterns may provide a modality for detecting color blindness, especially in children.

A feature of this invention therefore is that it provides a combined amusement, educational and intellectually stimulating puzzle game.

Another advantage of this invention is that the solution requires shiftable movement of the puzzle sections in accordance with logical reasoning processes.

Having thus summarized the invention, it will be seen that it is an object thereof to provide a movable surface global puzzle of the general character described herein which is not subject to the aforementioned disadvantages.

Specifically, it is an object of this invention to provide a movable surface global puzzle having a plurality of puzzle sections magnetically attracted to a spherical surface.

Another object of the present invention is to provide a movable surface global puzzle having selected patterns or images placed upon the surface of the puzzle sections and extending over two or more sections.

Still another object of this invention is to provide a movable surface puzzle wherein the solution requires the rearrangement of a random distribution of the puzzle sections by a series of shiftable movements so as to recreate the composite image.

Yet another object of this invention is to provide a movable surface global puzzle which is simple in construction, low in cost, reliable in use and well adapted for mass production fabrication techniques.

Other objects, features and advantages of the invention will in part be obvious and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown a possible exemplary embodiment of the invention:

FIG. 4 is a partial sectional view, to an enlarged scale, of a modified embodiment including a plurality of spur members;

FIG. 5 is a perspective view of another version of the movable surface global puzzle including forty-eight shell sections and illustrating a geometric pattern;

FIG. 6 is an isolated perspective view detailing a shell section to an enlarged scale and includes a handle member for removing the shell section from the central core; and FIG. 7 is a sectional view of the shell section along line 6—6 of FIG.6 showing a threadable socket for attachment of the handle to the shell section.

BEST MODE FOR CARRYING OUT THE INVENTION

Figure 1:
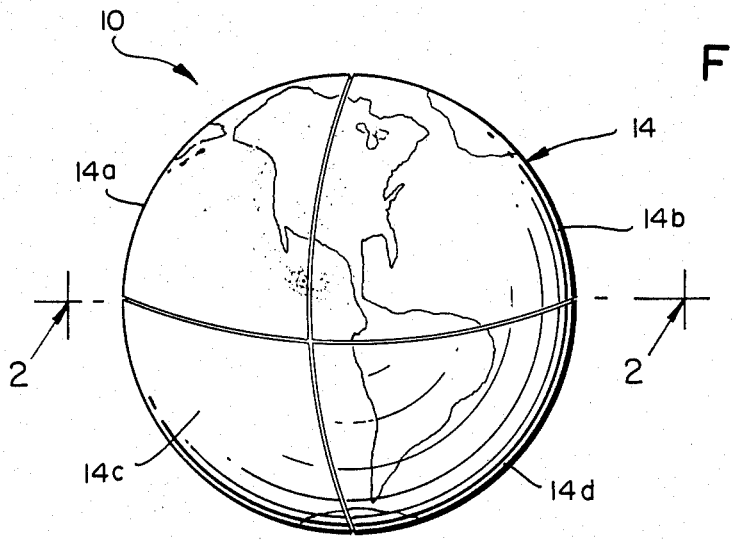
FIG. 1 is a perspective view of a movable surface puzzle in accordance with this invention showing an arrangement of eight shell sections depicting an image of a world map.

Referring now in detail to the drawings, FIG. 1 illustrates a preferred embodiment of a movable surface global puzzle in accordance with this invention and is denoted generally by the reference numeral 10.

The global puzzle 10 includes a hollow central core 12 and a concentric surface layer or shell 14. The core 12 is formed of a ferromagnetic material such as steel or similar substance having high magnetic permeance. The core 12 is magnetized by conventional methods and is intended to retain its magnetism and provide a permanent magnet. Further, in accordance with this invention, one region of magnetic polarity is located along a continuous outer surface 16 of the hollow core 12 and an opposite region of magnetic polarity is found at a continuous inner surface 18 of the core 12. In addition, the outer surface 16 is polished to provide a smooth unabraded finish. By way of example, the global puzzle 10 is approximately 100 mm. (4 inches) in diameter and the core 12 is 90 mm. (3½ inches) in diameter. The internal diameter of the core is about 65 mm. (2½ inches).

Figure 3:
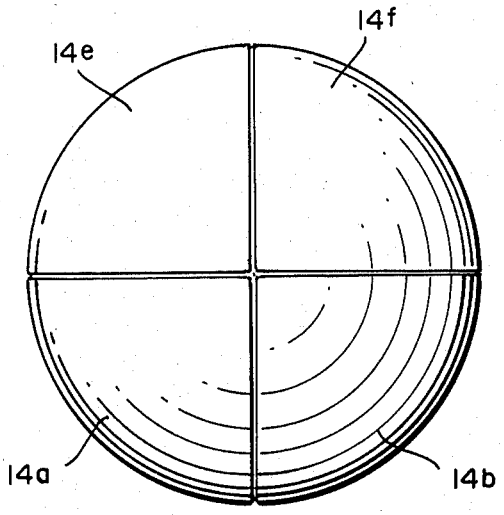
FIG. 3 is a plan view of the movable surface puzzle of FIG. 1 showing four of the eight shell sections.

The surface layer or shell 14, as shown in FIGS. 1 and 3 is segregated into eight identical sections 14*a* through *h*, which are formed by passing three mutually perpendicular planes through the center of the core 12. Thus, each of the sections 14*a* through *h* is a spherical triangle, and the sides of the triangles are defined by intersecting arcs of great circles. It should be additionally noted that the three vertices of each triangle are preferably rounded out, as best shown in FIG. 6, in order to facilitate movement between adjacent sections as will be further described hereinafter.

Referring once again to shell sections 14*a* through *h*, there is provided an externally exposed layer 20, preferably made of a nonmagnetic and durable material, e.g. plastic, and an internal layer 22 comprised of a magnetically attractable material such as steel.

The external layer 20 is bonded to the internal layer 22 or can be otherwise permanently secured thereto to form a laminate. A depiction of a world map such as shown in FIG. 1 or other design or image is imprinted upon or incorporated within the external layer 20 and forms part of a mosaic pattern extending over several shell sections. The thickness of the shell 14 is about 10 mm. (½ inch), the internal layer 22 is approximately 0.5 mm. (1/64 inch), and the dimension of the external layer 20 is about 9.5 mm. (⅜ inch).

Figure 2:
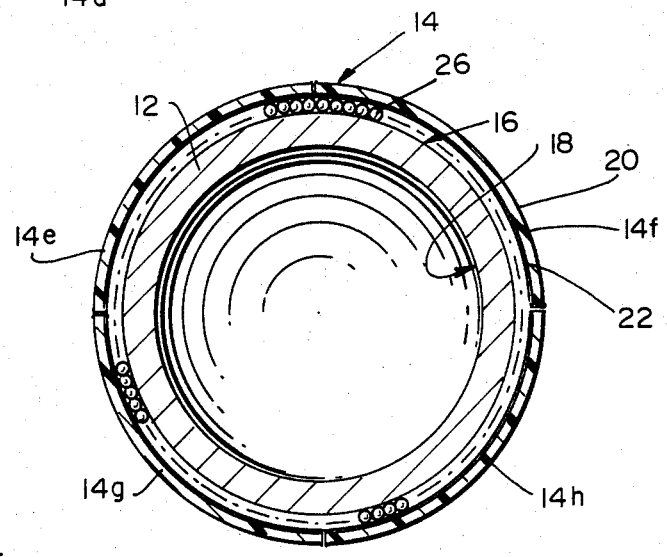
FIG. 2 is a sectional view taken substantially along line 2—2 of FIG. 1 showing a central core and the shell sections constituting a surface layer supported upon a plurality of roller bearings.

The internal layer 22 will be under the magnetic influence of the core 12 and thus is attracted and held tightly to the outer surface 16. In order to facilitate slidable movement and to reduce friction between the internal layer 22 and the outer surface 16, a plurality of slide elements have been introduced. In the preferred embodiment shown in FIG. 2, a plurality of steel ball bearings 26 have been utilized for providing rolling contact between the two surfaces. The magnetic field emanating from the central core 12 further acts upon the ball bearings for attraction to the outer surface 16. It should be noted that the magnetic attraction does not, however, inhibit relative slidable movement of the shell sections 14. It should also be apparent that, depending upon the strength of the magnetic field, nonmagnetic, e.g. nylon ball bearings, could also be utilized and would be retained between the shell sections 14 and the core 12.

In a modified version as illustrated in FIG. 4, a plurality of spur members 28 have been utilized for providing slidable contact between the shell sections 14 and the core 12. The spur members 28 are preferably conically shaped and formed integrally with the internal layer 22 and are designed for point contact with the outer surface 16.

The method of operation of the global puzzle 10 and an object thereof is to rearrange a random distribution of the individual shell sections 14*a* through *h* by a series of shiftable movements so as to recreate the composite pattern depicted on the externally exposed layer 20.

A variant embodiment of the invention is shown in FIG. 5. This version is structurally substantially the same as the preferred embodiment previously described with the exception that the shell 14 is now divided by nine planes passing through the center of the core 12 to form forty-eight shell sections in the form of spherical triangles. In addition, a geometric pattern employing different colors has been utilized at the intersection of the vertices of some of the triangles. It should also be apparent that the shell surface 14 can similarly be subdivided in alternate arrangements so as to provide a selected number of spherical triangles and further that a greater number of shell sections would increase the difficulty in solving the puzzle.

In another modification shown in FIGS. 6 and 7 a typical shell section such as 14*a* is provided with an internally threaded socket 30 formed in the externally exposed layer 20. A handle 32 includes a rod 34 having an externally threaded end 36 which is adapted for threadable connection to the socket 30. The purpose of the handle 32 is for removal of a selected shell section such as 14*a* from the central core 12. The remaining shell sections 14*b* through *h* can then be removed by hand and without the need for the handle 32. The purpose of this modification is to provide an alternate method for utilizing the puzzle and also to aid those less experienced or beginner players.

Having thus described the invention, it should be apparent that the movable surface global puzzle achieves the various objects of this invention and is well adapted to meet conditions of practical use.

Since various possible embodiments might be made of the present invention and various changes might be made in the exemplary embodiments set forth, it should be understood that all materials shown or described in the accompanying drawings are to be interpreted as illustrative and not in a limiting sense.

Having thus described the invention, there is claimed as new and desired to be secured by Letters Patent:

1. A movable surface global puzzle comprising a hollow central core, said central core including an outer spherical surface and an inner spherical surface, a shell spaced from and surrounding said core, said shell having at least two component sections, permanent magnetic means for providing an attractive interaction between the core and the shell wherein the outer spherical surface defines a region of magnetic polarity and the inner spherical surface defines a region of opposite magnetic polarity, slide means interposed between the shell and the core, said slide means providing for slidable displacement of the shell with respect to the core and relative movement between respective shell sections.

2. A movable surface global puzzle as claimed in claim 1 wherein the slide means is magnetically attracted to the central core.

3. A movable surface global puzzle as claimed in claim 2 wherein the slide means comprises a plurality of ball bearings.

4. A movable surface global puzzle as claimed in claim 1 wherein the slide means comprises spur members extending from the shell sections and adapted for slidable movement on the outer spherical surface.

5. A movable surface global puzzle claimed in claim 4 wherein the spur members are magnetically attracted to the central core.

6. A movable surface global puzzle as claimed in claim 1 wherein the shell is concentrically positioned about the central core.

7. A movable surface global puzzle as claimed in claim 6 wherein the shell is divided into discrete sections as defined by arcs of a great circle.

8. movable surface global puzzle as claimed in claim 6 wherein the shell is divided into eight identical sections, said sections being formed as spherical triangles.

9. A movable surface global puzzle as claimed in claim 6 wherein the shell is divided into forty-eight sections by nine planes intersecting the spherical core.

10. A movable surface global puzzle as claimed in claim 1 wherein the shell includes an outer layer of nonmagnetic material and an inner layer of magnetically attractive material.

11. A movable surface global puzzle as claimed in claim 10 wherein a world map is depicted upon the outer layer, said depiction extending to at least two shell sections.

12. A movable surface global puzzle as claimed in claim 10 wherein a geometric design is depicted upon the outer layer of said shell section, said design extending to at least two of said shell sections.

13. movable surface global puzzle as claimed in claim 1 further including handle means for cooperative engagement with the shell sections, said handle means being adapted for removal of said shell section from said core.

14. A movable surface global puzzle comprising a hollow spherical core having an outer and an inner spherical surface, said core being adapted for providing a magnetic field, said magnetic field including a region of magnetic polarity along the outer spherical surface and a region of opposite magnetic polarity along the inner spherical surface, a concentric shell surrounding the core, said shell being magnetically attracted by said magnetic field to said core, said shell further being divided into at least two sections, ball bearing slide means disposed between the outer spherical surface and concentric shell sections for providing shiftable displacement between the shell sections during concomitant movement of the shell sections about the core.

15. A movable surface global puzzle as claimed in claim 14 wherein said slide means are magnetically attracted to said core.

16. A movable surface global puzzle as claimed in claim 14 wherein shell sections are defined by planes passing through a center of the core.

* * * * *